United States Patent [19]

Tittmann

[11] Patent Number: 4,508,050

[45] Date of Patent: Apr. 2, 1985

[54] DOCTOR APPARATUS FOR COATING MACHINE

[76] Inventor: Frederick R. Tittmann, 1075 Oakland Ave., Plainfield, N.J. 07060

[21] Appl. No.: 564,382

[22] Filed: Dec. 22, 1983

[51] Int. Cl.[3] ..... B05C 11/02

[52] U.S. Cl. ..... 118/118; 118/119

[58] Field of Search ..... 118/118, 104, 119, 116, 118/117, 110

[56] References Cited

U.S. PATENT DOCUMENTS

| | | | |
|---|---|---|---|
| 2,221,441 | 11/1940 | Charters | 118/118 |
| 4,128,077 | 12/1978 | Meier | 118/118 X |
| 4,367,691 | 1/1983 | Bergs | 118/119 |

*Primary Examiner*—John P. McIntosh

*Attorney, Agent, or Firm*—Robert A. Green

[57] ABSTRACT

Doctor rod support apparatus, in a coating machine, comprising a support bar which carries inexpensive, simply shaped, doctor rod support members which are inexpensive off-the-shelf items and are mounted so that they can be simply and easily repaired or replaced.

9 Claims, 4 Drawing Figures

"PRIOR ART"

DOCTOR APPARATUS FOR COATING MACHINE

BACKGROUND OF THE INVENTION

This invention relates to apparatus for applying coatings to webs and, particularly, to a doctor rod assembly for performing metering and finishing functions in a coating apparatus. In known coating apparatus, doctor apparatus commonly includes a rod which is supported on apparatus having a generally V-shaped groove extending along its length, with the rod seated in the groove.

These grooved rod supports must be precisely machined, and, as a result, they are expensive to fabricate and replace, and their surfaces are easily damaged and worn.

The present invention provides an improved doctor apparatus which avoids the foregoing problems.

DESCRIPTION OF THE INVENTION

Figure 1:
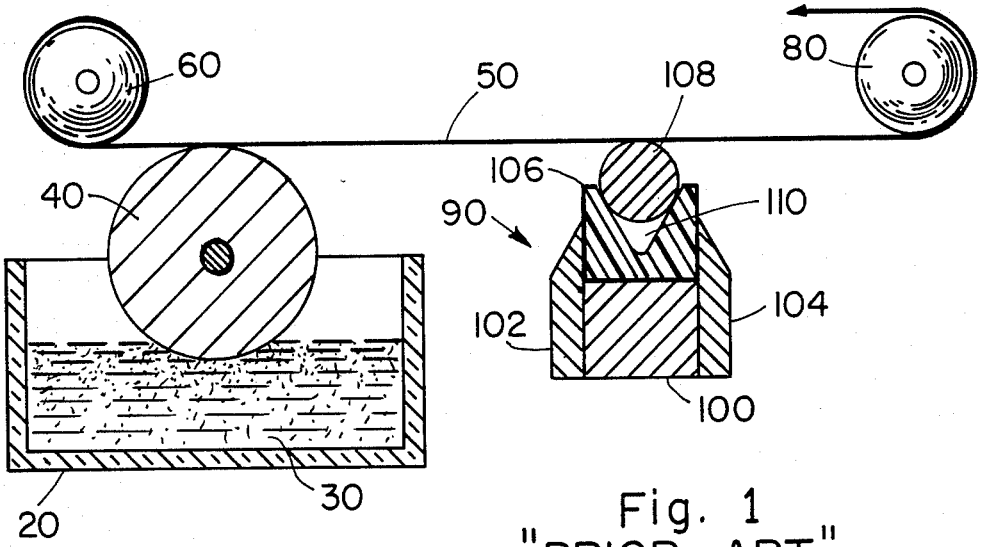
FIG. 1 is a schematic representation of coating apparatus in which the invention is used and a side elevational view, partly in section, of prior art doctor apparatus associated therewith.

One form of coating apparatus 10 with which the doctor apparatus of the invention is used is shown schematically in FIG. 1. Briefly, the apparatus 10 includes a container 20 of a coating substance 30 with a driven applicator roll 40 positioned horizontally, with its surface resting in the coating material. A sheet of film 50 to be coated is fed from a supply roll 60 over the applicator roll 40, across doctor apparatus 90, over one or more transport rolls 80, and then to any suitable apparatus for processing and storing the coated film as required.

The design requirements for the doctor apparatus 90 are stringent. The apparatus must (a) hold a doctor rod rigidly and allow maximum concentricity, (b) permit the doctor roll to rotate with minimal friction and wear, (c) permit quick removal and replacement of the doctor rod for cleaning to minimize downtime, (d) not have dead spots for coating buildup, i.e., should be streamlined for runoff of excess, scraped coating fluid, (e) not be bulky or overly sized, and (f) be readily accessible for replacement.

The prior art doctor apparatus 90, shown in FIG. 1 is subject to the problems noted above and does not meet all of the above requirements. The prior art apparatus 90 includes a metal holder base 100, to which two side plates 102, 104 are clamped with a doctor rod support 106 seated on the base 100 and clamped between the side plates 102 and 104. The doctor rod support 106 has a suitably deep V-shaped groove 110 which extends along the length of the rod support 106 and in which a doctor rod 108, of any type, is rotatably seated. The rod is positioned relatively deeply within the groove 110 so that it rests on the side walls of the groove.

Figure 2:
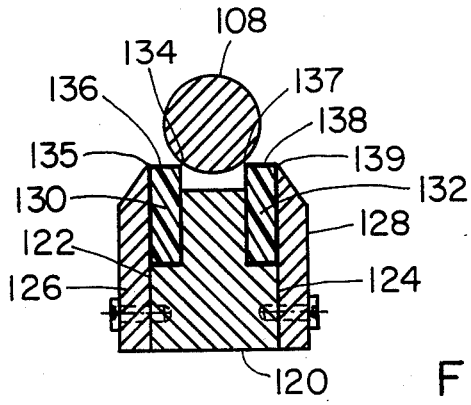
FIG. 2 is a side elevational view, partly in section, of one embodiment of the invention.

One embodiment of the invention shown in FIG. 2 includes an elongated holder base 120, of generally rectangular cross-section, having parallel side walls, to which side holder plates 126 and 128 are adjustably and demountably secured in any suitable fashion by screws or the like. Preferably, for streamlining and minimal cleaning, the plates 126 and 128 are sloped at their upper ends to permit fluid runoff.

According to the invention, between the holder base 120 and the side holder plates 126 and 128 are removably secured two wear wiper support strips 130 and 132. The strips 130 and 132 may be seated in notches in the side walls 122 and 124 of the holder base, if desired, and their upper surfaces 136 and 138, which are parallel and coplanar, extend above the holder base 120 and plates 126 and 128 sufficiently so that they are accessible to doctor rod 108 which is seated on them. These top surfaces 136 and 138 have inner and outer edges, with top surface 136 having inner edge 134 and outer edge 135, and top surface 138 having inner edge 137 and outer edge 139. The wear-wiper strips 130 and 132 are spaced apart a suitable distance by the base 120 so that the doctor rod 108 just sits on the inner edges 134 and 137 of the upper ends of the strips and between them so that the doctor rod makes essentially line contact therewith during rotation.

The wear-wiper support strips 130 and 132 are of a suitable synthetic resinous material such as TEFLON, NYLON, DELRIN, NYLON filled with molybdenum disulfide (MDS), and the like. The latter is preferred because of its outstanding wear resistance, low friction, and chemical resistance together with its commercial availability and low cost. One source of these strips as off-the-shelf items is McMaster-Carr Co.

In the apparatus of FIG. 2, the strips 130 and 132 are commercially available; they are not expensive, and they are easily replaced in the apparatus.

Figure 3:
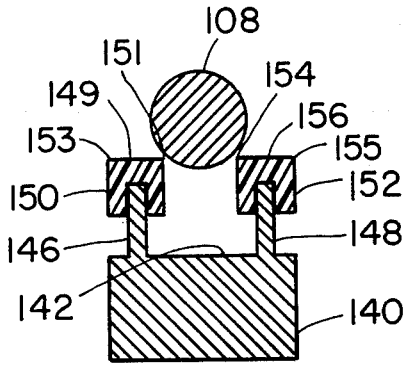
FIG. 3 is a side elevational view, partly in section, of a modification of the invention.
Figure 4:
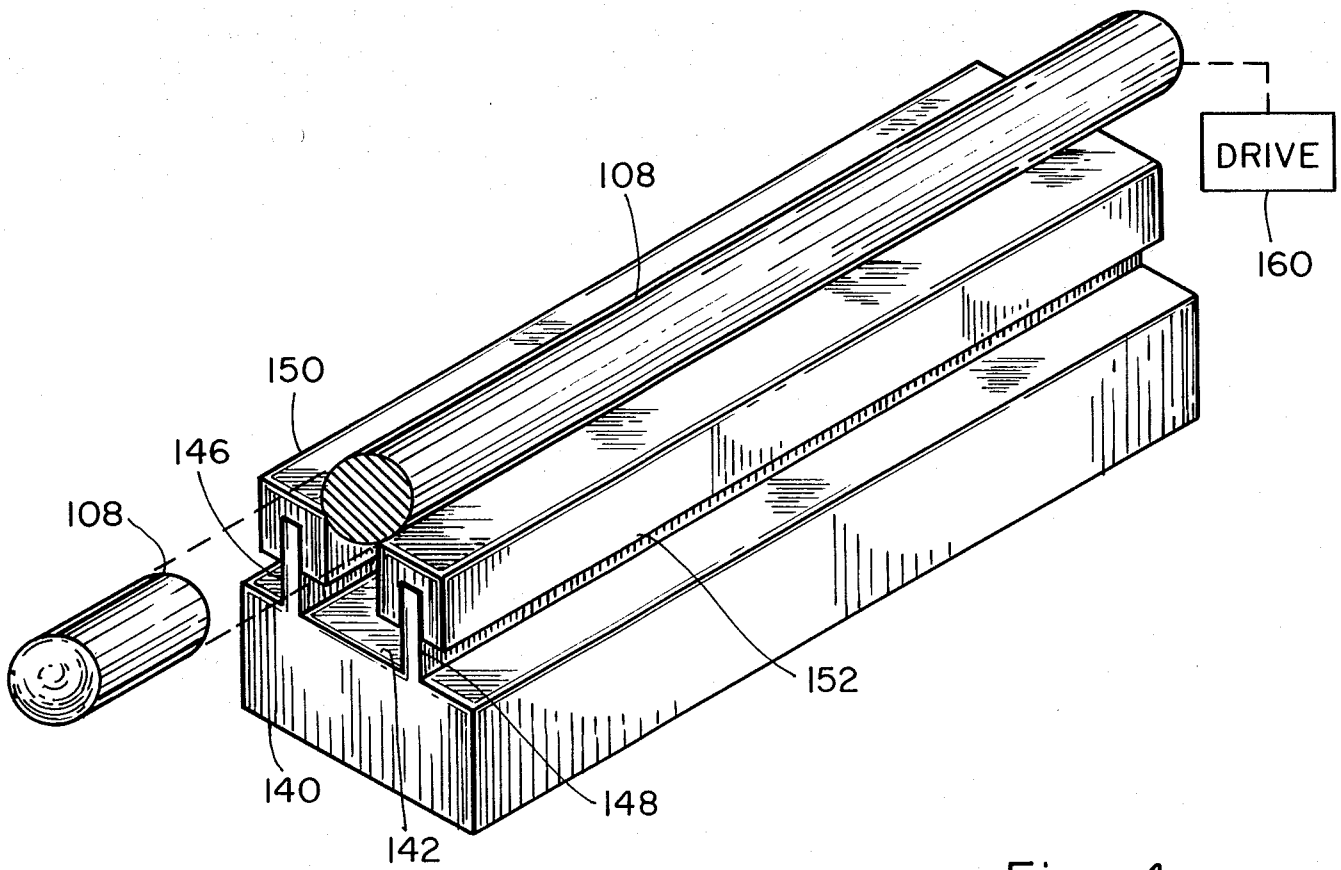
FIG. 4 is a perspective view of the apparatus of FIG. 3.

Another embodiment of the doctor assembly of the invention is shown in FIGS. 3 and 4 and includes a holder base 140 which is in the form of an elongated bar having a generally rectangular cross-section and having a top surface 142. Two spaced-apart, relatively narrow, parallel, generally rectangular profiled rails 146 and 148 rise from the top surface 142 of the base 140 and extend along the holder generally parallel to its longitudinal axis. In this case, wear-wiper strips 150 and 152 are seated on and grip the upper ends of the rails 146 and 148, respectively.

The wear-wiper strips are generally U-shaped and are inverted when they engage the rails 146 and 148. Each strip includes two spaced apart legs which define the "U" and a base between legs. The base has a flat outer surface with an inner edge and an outer edge. For purposes of illustrating the invention, it is only necessary to note that strip 150 has a top surface 149 which has inner edge 151 and outer edge 153, and strip 152 has a top surface 156 which has inner edge 154 and outer edge 155. The top surfaces 149 and 156 are coplanar. The strips 150 and 152 are so designed that they can be manually pushed onto the ends of the rails, with which they form a tight fit, and they remain secured to the rails during operation of the coating apparatus. At the same time, the strips can be readily removed from the rails manually for repair or replacement.

The doctor rod 108 rests on the inner edges of the upper ends of the wear-wiper strips 150 and 152, as in the apparatus of FIG. 2. Thus, there is essentially line contact between the rod 108 and strips 150 and 152. It is noted that, if the edge of a strip becomes worn, it can be turned around to present a new edge to the doctor rod.

When the apparatus of the invention is embodied in a coating machine, other apparatus well known in the art may be added; for example, hold-down belts may be applied to the doctor rod to provide a securing action. In addition, a drive mechanism 160 is coupled to the doctor rods, as illustrated in FIG. 4, and, similarly, other apparatus known in the art may be provided.

The present invention has been found to solve the problems of the prior art set forth above, and, in particular, it has the advantages of being inexpensive and easy to repair or replace. It also has the advantage that it is particularly effective with wide doctor rolls as much as 60 inches or more in width.

It is understood that various modifications may be made in the invention as described above. Of course, it is clear that any type of doctor rod can be utilized including a smooth rod or a wire-wound Mayer rod. In addition, a coating apparatus may include one doctor rod assembly or more than one in tandem. Other modifications will occur to those skilled in the art.

What is claimed is:

1. Doctor apparatus for use in a coating machine comprising a support base for a doctor rod, a pair of spaced-apart support members removably secured to said support base and having portions providing two horizontal support surfaces, said support surfaces having facing edges, and a doctor rod seated on the facing edges of said support surfaces provided by said spaced-apart support members, said support members being throwaway strips of simple construction and of a synthetic resinous material.

2. The apparatus defined in claim 1 wherein said support members comprise elongated, rectangular strips of a synthetic material removably held in place on said support base.

3. The apparatus defined in claim 1 wherein said support base includes a pair of upstanding spaced-apart rails which extend along the length of the base, and said support members are removably seated on the upper ends of said rails.

4. The apparatus defined in claim 3 wherein said support members are generally in the form of channels having a U-shaped profile, said rails being received within the channels.

5. The apparatus defined in claim 1 wherein said support base includes a main body having side walls, a pair of clamping plates removably secured to said side walls of said main body of said support base, said strips being clamped in place against said side walls of said main body by said clamping plates.

6. Doctor apparatus for use in a coating machine comprising a holder base having a top surface, a pair of spaced-apart parallel rails extending along said top surface, a removable support strip seated on each of said rails, said rails having spaced-apart facing edges, and a doctor roll rotatably seated on said facing edges of said support strips which provide line-engagement therewith.

7. Doctor apparatus for use in a coating machine comprising a holder base in the form of a generally rectangular elongated bar having a top surface, a pair of spaced-apart parallel rails extending along said top surface, said rails having upper ends having top surfaces which are coplanar, a removable support strip of synthetic resinous material seated on the upper end of each of said rails, and a doctor roll rotatably seated on said support strips and engaging an edge of each.

8. The apparatus defined in claim 7 wherein each of said support strips has a flat top surface which has first and second edges, the first edge of one strip facing the first edge of the other strip, said doctor roll resting on the first edge of said support strips.

9. The apparatus defined in claim 7 wherein said support strips comprise throwaway wear-wiper strips and are in the form of inverted U-shaped members seated on and gripping the upper ends of said rails.

* * * * *